US005266242A

United States Patent [19]

Mogendorf et al.

[11] Patent Number: 5,266,242

[45] Date of Patent: Nov. 30, 1993

[54] METHOD AND APPARATUS TO PREPARE A TRIBASIC PROPELLAT CHARGE POWDER

[75] Inventors: Klaus-Dieter Mogendorf, Waldkraiburg; Wolfgang Miehling, Mühldorf am Inn, both of Fed. Rep. of Germany

[73] Assignee: WNC-Nitrochemie GmbH, Aschau, Fed. Rep. of Germany

[21] Appl. No.: 635,169

[22] PCT Filed: Apr. 17, 1990

[86] PCT No.: PCT/EP90/00616

§ 371 Date: Jan. 7, 1991

§ 102(e) Date: Jan. 7, 1991

[87] PCT Pub. No.: WO90/13528

PCT Pub. Date: Nov. 15, 1990

[30] Foreign Application Priority Data

May 11, 1989 [DE] Fed. Rep. of Germany ..... 3915437

[51] Int. Cl.[5] ..... C06B 21/00; C06B 41/00

[52] U.S. Cl. ..... 264/3.3; 264/3.4; 264/3.5; 149/19.8; 149/19.92; 149/19.93; 149/109.6

[58] Field of Search ..... 264/3.3, 3.4, 3.5; 149/19.8, 19.92, 19.93, 109.6

[56] References Cited

U.S. PATENT DOCUMENTS

| | | | |
|---|---|---|---|
| 4,051,207 | 9/1977 | Brachert et al. | 264/3.2 |
| 4,076,773 | 2/1978 | Mahl, Jr. et al. | 264/3.5 |
| 4,376,083 | 3/1983 | Ulsteen | 264/3.4 |
| 4,525,313 | 6/1985 | Muller | 264/3.3 |
| 4,650,617 | 3/1987 | Kristofferson et al. | 264/3.3 |
| 4,726,919 | 2/1988 | Kristofferson et al. | 264/3.3 |
| 4,963,296 | 10/1990 | Niedermeier et al. | 264/3.3 X |

*Primary Examiner*—Peter A. Nelson

*Attorney, Agent, or Firm*—Lowe, Price, LeBlanc & Becker

[57] ABSTRACT

The invention relates to a method of and an apparatus for producing tribasic propellant charge powders. An operationally safe and continuous course of the production process is obtained according to the invention by first preparing a fully gelatinized dibasic intermediate product of nitrocellulose and a blasting or explosive oil, without solvent, in a shearing mill (1). The intermediate product is granulated and supplied to an extruder (4) into which the third crystalline energy carrier and solvents are introduced. There the pulverous mixture is homogenized and extruded to form powder strands which are moist with solvent.

11 Claims, 1 Drawing Sheet

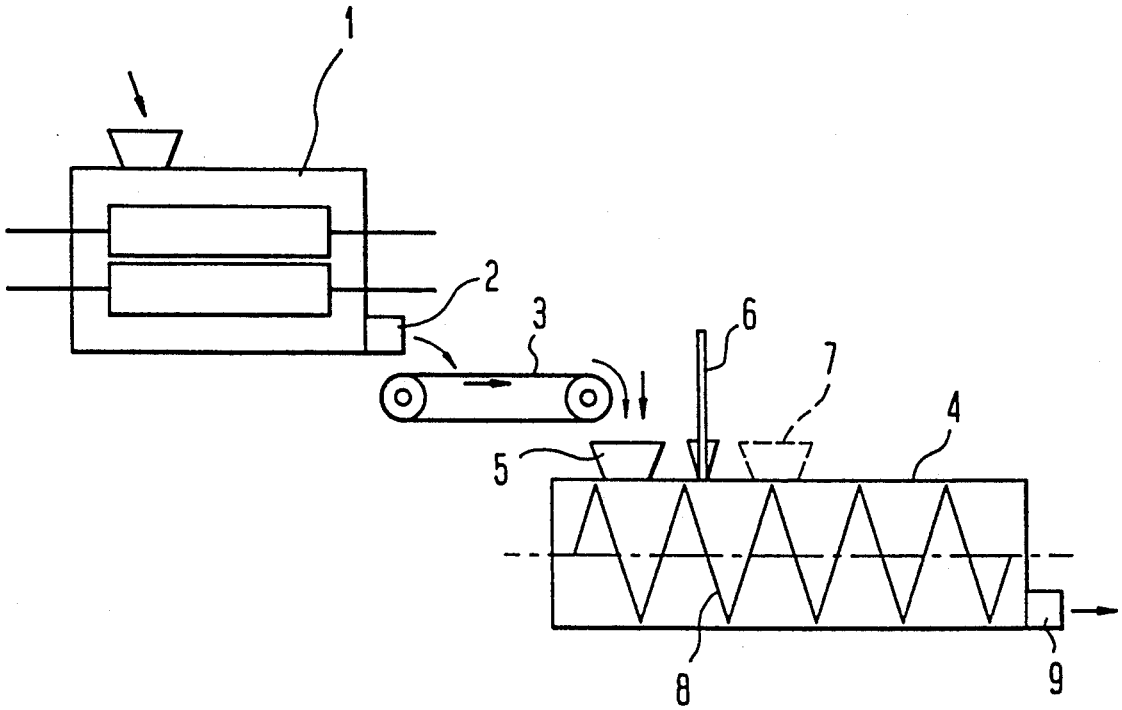
1
2
3
6
7
4
5
8
9

METHOD AND APPARATUS TO PREPARE A TRIBASIC PROPELLAT CHARGE POWDER

The invention relates to a method of making a tribasic propellant charge powder of nitrocellulose, blasting or explosive oil, and a third crystalline energy carrier, as well as additives, making use of a solvent. The invention also relates to an apparatus for carrying out that method.

The tribasic propellant charge powders are known also as "cold" powders. They have the advantage of better barrel protection, i.e. prevention of erosion than the conventional "hot" powders which do not contain a third crystalline energy carrier.

In making propellant charge powders with an explosive oil, this explosive oil acts as a gelatinizing agent for the nitrocellulose. In the case of tribasic propellant charge powders the quantity of blasting oil often is not sufficient for the complete gelatinizing of the nitrocellulose and for uniform and homogeneous binding of the third crystalline energy carrier in the powder mixture, particulary if the crystalline energy carrier is present in great proportion. In that event tribasic propellant charge powders are prepared with the use of an organic solvent as a gelatinizing aid. The solvent, such as a mixture of acetone and alcohol is added while the pulverous raw stock is being mixed and is withdrawn in the end from the finished powder.

The usual procedure is to produce tribasic propellant charge powders in batches. All the components of the powder, with the solvent being added, are mixed into a powder mass, which is moist with solvent, and kneaded in a closed kneader until the powder mass is homogenized and gelatinized. The gelatinized powder mass is compressed in a pot-type press to yield powder strands which subsequently are cut to length and from which the solvent is removed by drying. This procedure is very labor-intensive as the powder mixture requires a lot of manual treatment.

Likewise known is a method which can be operated continuously to produce tribasic propellant charge powders with solvents (German patent 24 61 646 and U.S. Pat. No. 4,051,207). With this procedure a mixture, moist with solvent, of all the components of the propellant charge powder is preplasticized in an open, continuously operating kneader, i.e. it is partly gelatinized. As a rule, the substance passes the kneader several times. Subsequently the preplasticized substance containing solvent is subjected to final gelatinizing in an extruder and converted into granular consistency. As a rule, the extruder, too, is to be passed several times. Thereupon the granular material is compressed in another extruder to yield the desired powder strands which still have to be cut to length and dried. This process is highly expensive in respect of the mechanical equipment needed and the process control which must be carried out in adjusting and monitoring process parameters.

It is an object of the invention to indicate an improved process of the kind defined initially adapted for continuous operation and to be realized with less mechanical expenditure than before, the operating cycle being easily adjustable and controllable. It is another object of the invention to provide an apparatus suitable for carrying out the process in question.

Starting from the process of the kind mentioned initially, the problem is solved in accordance with the invention in that raw stock moist with water and premixed of nitrocellulose moist with water and a blasting oil is gelatinized in a continuously operating open kneader, being dried at the same time, the kneading process being adjusted such that the raw stock upon leaving the kneading apparatus has been converted into a fully gelatinized intermediate product having a residual water content of less than 3%. When leaving the kneading apparatus the intermediate product is granulated, the granulated intermediate product (granular material) and the third crystalline energy carrier as well as the solvent are supplied to a continuously operating closed extruder in which they are homogenized by kneading and from which they are extruded as powder strands which are moist with solvent. These powder strands moist with solvent are cut to length and dried.

Blasting or explosive oil in the context of the instant application is to be understood as being the usual liquid explosives which are made use of in the preparation of propellant charge powders, including particularly nitroglycerine and diglycol dinitrate and mixtures thereof.

The third crystalline energy carrier normally is nitroguanidine (Nigu; NQ). Likewise suitable are hexogene (RDX) or octogene (HMX) or nitropenta (PETN) as well as other crystalline energy carriers and mixtures of the same.

The additives are those which are customary in the preparation of powders, especially plasticizers and stabilizers. Their share by weight in the powder mixture is relatively small.

Drying of the powder strands refers to any kind of measure which is customary in the production of powders to remove the solvent practically entirely from the powder strands.

The method of the invention is characterized in that not all of the components of the tribasic propellant charge powder are mixed together from the very beginning. At first, rather, a fully gelatinized intermediate product is made of nitrocellulose and blasting oil alone which are premixed to present raw stock which is moist with water. This is accomplished in a single pass through an open kneading apparatus, without the use of solvents. The gelatinized and, therefore, dry intermediate product is granulated, and the granular material is supplied together with the third crystalline energy carrier to a closed extruder. That is when the solvent is added too. The kneading action in the closed extruder converts the material into a homogeneous doughy mass in wich the crystalline energy carrier is finely distributed uniformly. This mass which is moist with solvent is extruded out of the same extruder, from the kneading, into powder strands which then are cut to length as usual and dried.

The method according to the invention on the whole can be carried out continuously. Essentially only two machines are needed to practice it, namely the open kneading apparatus and the closed extruder, plus a granulating means downstream of the open kneader and means for conveying the granular material to the extruder. Process control is easy. Each machine needs to be passed but once. Even a frequent change of the formulations causes no problems in resetting and harmonizing the respective process parameters and in seeing to it that they are maintained. It is advantageous in this context that the first part of the method, the treatment of the raw stock in the open kneader, hardly takes a different course from the usual production of dibasic propellant charge powders so that in this respect the routine and experience of that production can be relied on. Moreover, this assures a high degree of safety. The risk of spontaneous ignition of the powder mixture in any production process is particularly high until the nitrocellulose has become fully gelatinized by the blasting oil for example, because blasting oil is separated from the raw stock. During that phase, however, the method according to the invention is carried out only in the open kneading apparatus where the consequences of any spontaneous combustion are much more harmless than in a closed processing machine, such as an extruder. In the extruder, on the other hand, the risk of explosion is greatly reduced with the method according to the invention because of the addition of the solvent. Finally, the method according to the invention can do with a much smaller quantity of solvent, based on the production quantity, than the customary production process. Consequently, also the loss of solvent in drying the extruded powder strands is less, and that makes the proces more economical and contributes to the protection of the environment. For the same reason, the drying expenditure is much less in comparison with the conventional method.

The open kneading apparatus used preferably is a shearing mill which is known as such for homogenizing and plasticizing non-explosive thermoplastic substances, such as plastics (EP-A 0 148 966 and U.S. Pat. No. 4,605,309). Reference is made specifically to those two publications for any further details of such a shearing mill. The shearing mill comprises two rollers which are adapted to be driven independently of each other and between which an adjustable roller nip is defined. The rollers are formed with spiralling grooves which assure that the material being processed is fed reliably into the nip and which, at the same time, generate axial conveying movement in the roller nip from one end of the roller pair to the other. With the method of the invention the raw stock moist with water is fed continuously to the two rollers of the simultaneous rolling mill at one end thereof in order then to be conveyed gradually to the other end of the two rollers while being kneaded and subjected to intensive shearing. The raw stock which arrives at the other end then is fully gelatinized. To permit such gelatinizing, the water must be removed from the raw stock. That is accomplished by squeezing in the roller nip and also by evaporation of water since the rollers of the shearing mill are heated. The raw stock supplied to the shearing mill preferably has a water moisture content of 20% to 30%. The removal of that water and the corrresponding progressing gelatinizing of the raw stock takes place gradually as the raw stock travels along the rollers. Adjustment of the roller nip and of the numbers of revolution of the two rollers permits process control such that the raw stock at the discharge end of the roller pair is practically dry and, therefore, fully gelatinized. This means that the residual water level is less than 3%, preferably less than 1%, being e.g. 0.5%. The fully gelatinized raw stock is located on one of the two rollers from which it may be removed continuously, while being granulated at the same time, for instance by a granulating head.

The method according to the invention also has the advantage that formulations can be observed very strictly so that the production of different propellant charge powders is exactly reproducible since both the intermediate product, because of its granulation, and the third crystalline energy carrier can be supplied to the extruder in accurately metered quantities, such as by means of suitable dosing devices. There are various possibilites of feeding the extruder. If, in working direction of the extruder, first the granular material and the crystalline energy carrier and subsequently the solvent are added, the necessary extruder can be of especially simple design as only one common opening is needed for the granular material plus crystalline energy carrier. The formation of bridges and plugging in the input opening for the granular and energy carrier materials are avoided because the solvent is added downstream of the feeding location of those materials. It proved that the homogeneity of the powder strand is even better if first the granular material, then the solvent, and thereafter the crystalline energy carrier are added in the working direction of the extruder. For that purpose the extruder must be furnished with a first feeding opening in working direction for introduction of the granular material, a subsequent opening for supply of the solvent, and finally an opening for supply of the crystalline energy carrier under pressure, an arrangement which is somewhat more complicated technically.

The additives may be supplied together with the premixed raw stock moist with water to the kneading apparatus. Alternatively, the additives may be supplied together with the granular material and/or the crystalline energy carrier to the extruder. In specific cases, depending on the formulation, for instance, it may be convenient to make use of both possibilities in combination, such as by feeding certain additives to the kneader and the remainder to the extruder.

The raw stock supplied to the simultaneous rolling mill usually comprises from 40% to 60%, preferably from 45% to 55% of nitrocellulose. The crystalline energy carrier is supplied to the extruder in an amount of from 10% to 55%, preferably from 40% to 55%, based on the granular material fed previously.

The quantity of solvent supplied to the extruder conveniently ranges from 60 to 130 grams per kilogram of solids supplied (granular material+crystalline energy carrier). This means that from 30% to 60% of solvent are saved as compared to conventional manufacturing methods. Suitable solvents among others are alcohol or acetone. The choice depends among others on the degree of nitration of the nitrocellulose employed. The higher the degree of nitration, the more solvent generally is needed or the stronger the solvent must be.

An apparatus for carrying out the method according to the invention is characterized by an open shearing mill, a downstream granulating means, a conveying means, and a closed extruder.

The invention will be described further, by way of example, with reference to the accompanying drawing, in which the only FIGURE is a diagrammatic presentation of an apparatus for preparing tribasic propellant charge powders.

The apparatus illustrated comprises an open shearing mill 1, as known, for example from U.S. Pat. No. 4,605,309. The shearing mill comprises two rollers which are adpated to be driven independently of each other and between which a roller nip or gap is defined. Pulverous raw stock moist with water and premixed of nitrocellulose moist with water and blasting oil is supplied to the simultaneous rolling mill at one end of the two rollers. This supply is indicated in the drawing by a funnel and an arrow. In the shearing mill the raw stock is kneaded, thereby being gelatinized with the water being removed. During processing, the raw stock travels toward the other end of the two rollers, and the raw stock arriving at the other end is fully gelatinized. A granulating means 2 is associated with this end of the two rollers. It removes the gelatinized raw stock or intermediate product from one of the two rollers and granulates it at the same time. A conveying means 3 carries the granulated intermediate product (granular material) to the feeding opening 5 of a closed extruder 4. The third crystalline energy carrier is fed into the same feeding opening 5. The granular material and the third energy carrier conveniently each are introduced through a metering device, not shown. Behind the feeding opening 5, in flow direction, the extruder 4 is furnished with an adding means 6 for entry of the solvent. Alternatively, another feeding opening 7 may be provided downstream of the adding means 6 for feeding the crystalline energy carrier separately from the granular material to the extruder. If so, that must be done under pressure because pressure already has built up in the interior of the extruder in the area of the feeding opening 7.

The extruder 4 is provided in the usual manner with one or two screws 8 which are supported for rotation in the housing of the extruder and indicated only diagrammatically in the drawing. A die (not shown) is arranged at the outlet area 9 of the extruder. The material is extruded through this die to form powder strands. The kneading action inside the extruder turns the granular material and the third energy carrier together with the solvent, e.g. alcohol, into a doughy mass in which the third crystalline energy carrier is finely distributed homogeneously. This mass which is moist with solvent is extruded at the end through the die, e.g. into a 7-hole powder strand. The powder strands exiting from the extruder are cut to length in conventional manner (not shown), and the solvent is removed from the same in suitable manner, e.g. in a drier.

The two rollers of the shearing mill are heatable to temperatures between 80° C. and 120° C. The adjustable range of the rotational speed of the two rollers lies between 40 and 70 r.p.m. The gap width or nip between the two rollers as a rule is set to less than 2 mm. The granulating means 2 yields granular material of a size from 3 to 6 mm. The extruder 4 typically is of such design that its length to diameter ratio is from 20 to 24. The temperature inside the extruder is between 20° C. and 50° C. The number of revolutions of the screw is adjustable between 30 and 80 r.p.m.

To prepare a certain tribasic propellant charge powder, premixed raw stock consisting of 46% of nitrocellulose ($N_2$=13,1%), 46% of nitroglycerine, 8% of centralite I, and 0.7% of cryolite is processed in the shearing mill 1 at a temperature of the one roller thereof of 90° C. and a rotational speed of 68 r.p.m. The temperature of the other roller is 80° C. and its rotational speed 58 r.p.m. The mean throughput of the shearing mill is 52 kilograms per hour of material which is moist with water. The raw stock when fully gelatinized, i.e. the intermediate product at the granulating means 2 has a content of water of less than 0.5%. The dry granular material and nitroguanidine, as the third energy carrier, are metered into the extruder at a weight ratio of 45% of granular material and 55% of nitroguanidine. In the extruder, the material is homogenized with the aid of solvent and extruded to form a 7-hole powder. The throughput is 40 kilograms per hour at a rotational speed of the screw of 60 r.p.m. and an extruder head pressure of 23 bar.

To prepare another tribasic propellant charge powder, premixed raw stock consisting of 62% of nitrocellulose, 37% of nitroglycerine, 0.3% of centralite, 0.5% of arcadite, 0.1% of magnesium oxide, and 0.1% of graphite having an initial water content of 28% is processed in the shearing mill 1. The temperature of the first roller is 110° C., its rotational speed 50 r.p.m. The temperature of the second roller is 90° C. and its rotational speed 45 r.p.m. The resulting throughput is 42 kilograms per hour of dry mass at a water level of approximately 0.7% at the granulating means. The granular material and nitroguanidine are metered into the extruder at a weight ratio of 60%:40% . In the extruder they are treated with acetone, as the solvent, in an amount of 3 liters per hour. The material is extruded to yield a 7-hole bulk powder. The rotational speed of the screw is 40 r.p.m., the head pressure is 27 bar, and the head temperature is 48° C. The resulting throughput is 30 kilograms per hour.

what is claimed is:

1. A method of preparing a tribasic propellant charge powder comprising nitrocellulose, blasting oil, and a third crystalline energy carrier, said method using a solvent and being characterized by the following steps:

(a) gelatinizing a raw stock comprising a premixed paste of 40 to 60% nitrocellulose, a blasting oil, and a water moisture content of 20 to 30% is a continuously working, open kneading apparatus, said raw stock being dried simultaneously, the raw stock, upon leaving the kneading apparatus, being converted into a fully gelatinized intermediate product having a residual water content of less than 3%;

(b) granulating the intermediate product as it leaves the kneading apparatus;

(c) supplying the granulated intermediate product, a third crystalline energy carrier and a solvent to a continuously working, closed extruder in which they are homogenized by kneading and extruded in the form of powder strands moist with solvent;

(d) cutting the powder strands moist with solvent to length and drying the same.

2. The method as claimed in claim 1, characterized in that the kneading apparatus is an open shearing mill.

3. The method as claimed in claim 1, characterized in that the granulated intermediate product and the crystalline energy carrier are first added together to the extruder, in an operating direction thereof, after which the solvent is added.

4. The method as claimed in claim 1, characterized in that the granulated intermediate product, the solvent, and the crystalline energy carrier are added consecutively in an operating direction of the extruder.

5. The method as claimed in claim 11, characterized in that additives are supplied to the kneading apparatus together with the premixed raw stock.

6. The method as claimed in claim 1, characterized in that additives are supplied to the extruder together with the granulated intermediate product material and/or the crystalline energy carrier.

7. The method as claimed in claim 1, characterized in that crystalline energy carrier is supplied to the extruder in an amount of from 10% to 55% of the granulated intermediate product supplied to the extruder.

8. The method as claimed in claim 1, characterized in that the solvent is supplied to the extruder in an amount of from 60 to 130 grams per kilogram of the granulated intermediate product and the crystalline energy carrier combined supplied to the extruder.

9. The method as claimed in claim 1, characterized in the raw stock is free of the third crystalline energy carrier and the solvent.

10. An apparatus for carrying out the method as claimed in claim 1, characterized by comprising, in the following operating order, an open shearing mill, a subsequent granulating means, a conveying means, and a closed extruder.

11. The apparatus as claimed in claim 10, characterized in that, in its operating direction, the extruder has a first feed opening for the granulated intermediate product, an opening for supply in the solvent, and finally an opening for supplying the crystalline energy carrier under pressure.

* * * * *